US009625239B2

(12) United States Patent
Flynn

(10) Patent No.: US 9,625,239 B2
(45) Date of Patent: Apr. 18, 2017

(54) TARGET LABEL ASSEMBLY

(71) Applicant: Timothy J. Flynn, Key Largo, FL (US)

(72) Inventor: Timothy J. Flynn, Key Largo, FL (US)

( * ) Notice: Subject to any disclaimer, the term of this patent is extended or adjusted under 35 U.S.C. 154(b) by 0 days.

(21) Appl. No.: 15/054,386

(22) Filed: Feb. 26, 2016

(65) Prior Publication Data

US 2016/0327376 A1 Nov. 10, 2016

Related U.S. Application Data

(60) Provisional application No. 62/157,861, filed on May 6, 2015.

(51) Int. Cl.

| | |
|---|---|
| ***F41J 5/00*** | (2006.01) |
| ***F41J 1/00*** | (2006.01) |
| ***F41J 5/20*** | (2006.01) |
| *F41J 5/14* | (2006.01) |
| *F41J 5/24* | (2006.01) |

(52) U.S. Cl.

CPC . *F41J 5/00* (2013.01); *F41J 1/00* (2013.01); *F41J 5/205* (2013.01); *F41J 5/14* (2013.01); *F41J 5/24* (2013.01)

(58) Field of Classification Search

CPC ..... F41J 5/18; F41J 5/24
USPC ..... 273/378, 380, 403–410
See application file for complete search history.

(56) References Cited

U.S. PATENT DOCUMENTS

| | | | | |
|---|---|---|---|---|
| 1,145,585 A | | 7/1915 | Hebard | |
| 1,723,826 A | | 8/1929 | Van Auken | |
| 1,825,292 A | | 9/1931 | Van Auken | |
| 3,330,561 A | | 7/1967 | Kandel | |
| 3,353,827 A | | 11/1967 | Dun, Jr. | |
| 3,370,852 A | | 2/1968 | Kandel | |
| 3,423,092 A | * | 1/1969 | Kandel | F41J 1/01 273/378 |
| 3,895,803 A | * | 7/1975 | Loe | F41J 1/01 273/378 |
| 3,899,175 A | | 8/1975 | Loe | |
| 4,066,261 A | | 1/1978 | Stewart | |
| 4,462,598 A | | 7/1984 | Chalin et al. | |
| 4,498,677 A | * | 2/1985 | Dapkus | F41J 5/24 102/335 |

(Continued)

FOREIGN PATENT DOCUMENTS

| | | |
|---|---|---|
| EP | 0 069 668 A2 | 1/1983 |
| GB | 191320060 | 0/1914 |
| UA | 55326 U | 12/2010 |

OTHER PUBLICATIONS

Co-pending U.S. Appl. No. 15/054,411, Multi-Sided Target Assembly, filed Feb. 26, 2016.

*Primary Examiner* — Mark Graham
(74) *Attorney, Agent, or Firm* — Pauley Erickson & Kottis

(57) ABSTRACT

An improved target label for shooting that includes at least one toner layer defining an image of a target, superimposed over a colored substrate having a color different from the toner layer, and a release layer underlying the toner layer. When a projectile strikes and penetrates the target, the toner layer displaces and scatters over an area surrounding the point of penetration, exposing the underlying colored substrate layer. The scattering of toner particles visually resembles gun powder and visually simulates damage over an area wider than the point of penetration by the projectile.

28 Claims, 2 Drawing Sheets

(56) References Cited

U.S. PATENT DOCUMENTS

| | | | | | |
|---|---|---|---|---|---|
| 4,921,256 | A * | 5/1990 | Gearhart | F41J 1/01 | 273/378 |
| 5,186,468 | A * | 2/1993 | Davies | F41J 5/24 | 273/378 |
| 5,188,371 | A * | 2/1993 | Edwards | F41J 1/01 | 273/378 |
| 5,275,890 | A * | 1/1994 | Wolf | B32B 27/10 | 273/408 |
| 5,501,467 | A * | 3/1996 | Kandel | F41J 1/01 | 273/378 |
| 5,544,881 | A * | 8/1996 | Rua, Jr. | A63F 3/062 | 273/139 |
| 5,580,063 | A * | 12/1996 | Edwards | F41J 1/01 | 273/378 |
| 6,019,375 | A | 2/2000 | West, Jr. | | |
| 8,444,056 | B2 | 5/2013 | Gamez et al. | | |
| 8,545,226 | B2 | 10/2013 | Norden et al. | | |
| 8,556,268 | B2 * | 10/2013 | Su | F41J 1/01 | 273/378 |
| 8,596,643 | B1 * | 12/2013 | Edwards | F41J 5/00 | 273/378 |
| 8,899,591 | B1 | 12/2014 | Donaldson | | |
| 8,984,663 | B2 | 3/2015 | Lee et al. | | |
| 9,170,077 | B2 * | 10/2015 | Johnson | F41J 5/24 | |
| 9,234,726 | B2 * | 1/2016 | Sharrock | F41J 5/24 | |
| 2007/0046760 | A1 * | 3/2007 | Zara | F41J 5/22 | 347/105 |
| 2008/0054570 | A1 | 3/2008 | Potterfield et al. | | |
| 2009/0058008 | A1 * | 3/2009 | Baumgartner | B29C 51/10 | 273/408 |
| 2009/0166968 | A1 * | 7/2009 | Stephens | A63F 3/0665 | 273/139 |
| 2011/0316234 | A1 | 12/2011 | Miller, Sr. | | |
| 2016/0327377 | A1 | 11/2016 | Flynn | | |

* cited by examiner

TARGET LABEL ASSEMBLY

CROSS REFERENCE TO RELATED APPLICATIONS

This application claims the benefit of, U.S. Provisional Patent Application Ser. No. 62/157,861, filed on 6 May 2015. The Provisional patent application is hereby incorporated by reference herein in its entirety and is made a part hereof, including but not limited to those portions which specifically appear hereinafter.

FIELD OF THE INVENTION

This invention is directed to an improved target label assembly for shooting, which, when penetrated by a projectile, exposes multiple colors over an area surrounding the penetration.

BACKGROUND OF THE INVENTION

Various target labels are known which, upon receiving a projectile, expose an area of color that is larger than the cross-sectional area of the projectile. U.S. Pat. No. 7,631,877, issued to Zara, discloses a target including a substrate, a first ink layer covering at least part of the substrate, and a second ink layer carried by the substrate. The second ink layer includes a first section having a first color and covering at least part of the first ink layer, and a second section having a second color different than the first color. The second ink layer is configured so that the impact of a firearm projectile detaches a portion of the second ink layer from the substrate and exposes a portion of the substrate and/or the first ink layer. In another disclosed embodiment, the target includes a substrate and an ink layer carried by the substrate. The ink layer includes a first section having a first color and a second section having a second color different from the first color. The target is configured so that penetration of a projectile removes a portion of the ink layer and exposes a surface adjacent to the ink layer.

U.S. Pat. No. 3,895,803, issued to Loe, discloses a laminar firearm target including a brightly colored backing sheet, a transparent plastic film bonded to the backing sheet, and a target pattern printed in a black and white ink layer on the front side of the transparent plastic film so as to completely obscure the brightly colored backing sheet. When a projectile strikes the target, a substantially larger than projectile-size portion of the ink layer is removed at the impact point, while a smaller hole is made in the plastic film and backing sheet, exposing an area of the brightly colored backing sheet.

U.S. Publication 2011/0316234 to Miller, Sr. discloses a reactive target for guns that fire non-metallic BB's. The target uses the kinetic energy stored in a plastic BB after it has been launched and transfers that energy into the target mass, causing a colored particulate matter to be expelled into the surrounding area and make a mark on the target surface.

U.S. Pat. No. 5,275,890 to Wolf et al. discloses a gun target including substantially planar first and second sheets. The first sheet has a back surface and an exposed front surface which carries a graphic pattern having a first color, at which the weapon is aimed. The second sheet is connected to the back surface of the first sheet and has a contrasting color relative to the first color. When a round fired from the weapon into the graphic pattern penetrates both sheets, the resulting hole exposes the second color at the front surface of the first sheet.

The foregoing targets all have the ability to expose a colored area around the hole made by the projectile, to amplify the visual impact when the target is hit. In the competitive field of target labels, there is a need or desire for cost-efficient target labels that further enhance the visual impact when the target is hit.

SUMMARY OF THE INVENTION

The present invention is directed to an improved target label that uses toner instead of ink to define a target image, and may also use toner to form an underlying colored layer. In contrast to ink, toner is predominantly a powder, and is used in laser printers and photocopiers to form the text and images on printed paper. The primary components of toner are a powdered polymer such as styrene-acrylate copolymer, polyester, or styrene-butadiene copolymer, sometimes blended with carbon black and/or iron oxide powder. Various toner colors can be synthesized by blending the polymer with a pigment before forming the powder. Toner can be prepared by compounding the ingredients and forming a slab, which is then pulverized to the desired particle size. Toner powder can have a particle size ranging from about 16 micrometers down to about 8-10 micrometers or less.

In conventional applications, toner particles are melted by the heat of the fuser in the printer, causing them to individually bond to the underlying material. For purposes of the invention, a more desirable technique is to mix the toner powder with an aqueous carrier to form liquid toner. The liquid toner is applied at room temperature and dried, resulting in minimal adhesion of the toner to the underlying layer. This promotes scattering of the toner powder when the target is struck by a firearm projectile. The liquid toner may include about 20-80% by weight toner powder and about 20-80% by weight of the aqueous carrier, suitably about 30-70% by weight toner powder and about 30-70% by weight of the aqueous carrier.

Ink, by contrast, is a liquid or paste that contains pigments or dyes carried by a solvent. Ink strongly adheres to the substrate upon drying the solvent. Ink can be a complex medium of solvents, pigments, dyes, resins, lubricants, solubilizers, surfactants, particulate matter, and fluorescents. As used herein, the terms "toner" and "ink" are mutually exclusive of each other.

In one embodiment, the invention is directed to a target label that includes a colored substrate including at least one paper or plastic layer and having a first color, the colored substrate having a front surface and a back surface; a transparent plastic film having a front surface and a back surface, the back surface of the transparent plastic film overlaying the front surface of the colored substrate; a release layer overlaying the front surface of the transparent plastic film; and a toner layer defining an image of a target, overlaying the release layer, and having a second color different from the first color.

In another embodiment, the invention is directed to a target label that includes a colored substrate having a front surface and a back surface, including at least one paper or plastic layer and at least one toner layer having a first color disposed over the paper or plastic layer and defining the front surface; a transparent plastic film having a front surface and a back surface, the back surface of the transparent plastic film overlaying the front surface of the colored substrate; a second toner layer defining an image of a target, overlaying the front surface of the transparent plastic film and having a second color different from the first color; and a release agent in the second toner layer or between the second toner layer and the front surface of the transparent plastic film.

In another embodiment, the invention is directed to a target label that includes a colored substrate including at least one paper or plastic layer and having a first color, the colored substrate having a front surface and a back surface; a toner layer defining an image of a target, overlaying the front surface of the colored substrate and having a second color different from the first color; and a release agent in or adjacent to the toner layer. The toner layer includes first and second sections and at least one gap between the first and second sections. The first section has a second color, the second section has a third color, and the first, second and third colors are different from each other.

Because the toner layer(s) are formed of discrete particles, suitably with minimal adhesion, they can have improved scattering properties when the target is hit, causing the visual appearance of gun powder burns surrounding the area of the target penetrated by a projectile, in addition to exposing underlying colored layer(s). The exposure of one or more underlying colors, combined with the visual appearance of powder burns, enhances the enjoyment of using the target labels for target practice.

DETAILED DESCRIPTION OF THE INVENTION

Figure 1:
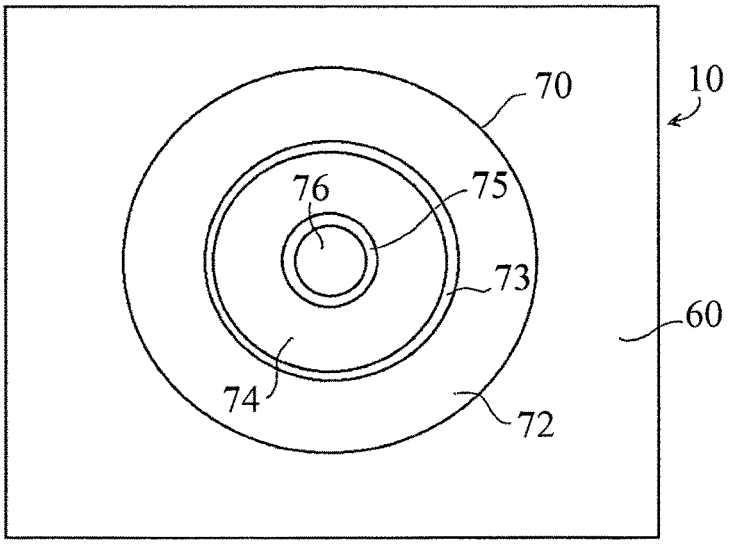
FIG. 1 is a plan view of a target label of the invention, showing the front of the target label.
Figure 2:
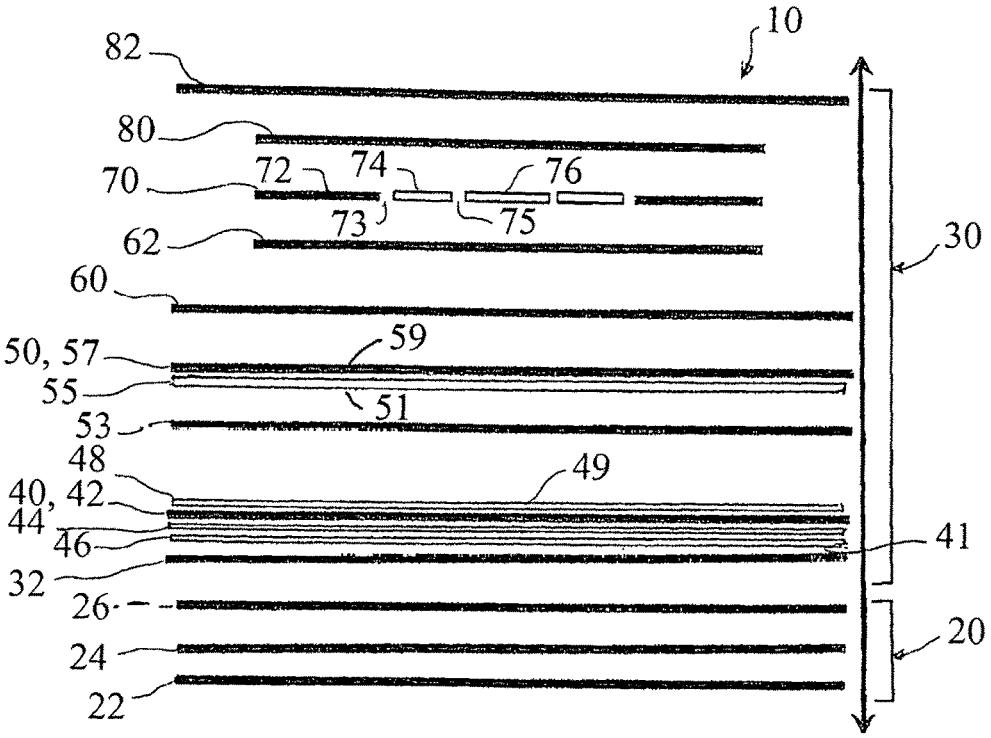
FIG. 2 is an exploded side view of the target label of FIG. 1, showing the individual layers, and showing overlaying layers of clear coating or varnish.

Referring to FIGS. 1 and 2, a target label assembly 10 includes a liner assembly 20 and a target label 30. The liner assembly 20 is initially releasably joined to the target label 30 and is peeled away when the target label 30 is ready for mounting to a mounting board or other device (not shown). The liner assembly 20 includes a paper or film liner 22, a sizing coating 24, and a release agent which can be incorporated into the sizing coating or applied as a separate release layer 26.

The liner 22 can be formed of paper, polymer-coated paper, polyester film, high density polyethylene film, low density polyethylene film, biaxially oriented polypropylene, and a wide variety of polymers and polymer combinations. Suitable paper liners include without limitation super calendared kraft paper with or without a polyvinyl alcohol coating, clay coated kraft paper, machine finished kraft paper, and machine glazed kraft paper. The coating layer 24, which can also serve as a release layer, can be formed of silicone, polytetrafluoroethylene, polyethylene terephthalate, polyamide, polyacrylonitrile, or the like. When the coating layer 24 does not have sufficient release properties, a separate release layer 26 formed of silicone or another suitable release material can be included.

During use, the release assembly 20 is removed from the target label 30 to expose a pressure-sensitive adhesive layer 32, used to secure the target label 30 to a mounting device. The target label 30 includes a colored substrate 40 having a first color. The colored substrate 40 can be a single layer 42 of paper or plastic film, or can include additional layers, such as the illustrated layers 44, 46 and 48. The layer 42 can be a colored paper or plastic film having the first color imparted by dyeing or otherwise pigmenting the paper or plastic film during its manufacture, and does not require application of an ink layer. The colored substrate 40 can be devoid of ink layers. The paper layer can be selected from a wide variety of commercially available colored papers that have suitable thickness and integrity to serve as a substrate for a target label. When a colored plastic is used for layer 42, the plastic can be selected from low density polyethylene, linear low density polyethylene, polypropylene, polyester, polyamide, and a wide variety of other polymers having suitable integrity at the desired thickness.

In alternative embodiments, the colored substrate 40 may include additional layers, such as the illustrated layers 44, 46 and 48. In one embodiment, the layers 44 and 46 can be colored paper or plastic layers, or both, having colors that are different from each other and different from the first color of layer 42. When multiple substrate layers with different colors are used, the layers can be designed so that when a projectile hits the target, a "starburst" or "halo" of multiple colors is observed around the point of impact, as described below with respect to FIG. 4. The colored substrate layers 42, 44 and 46 can be any combination of colored paper layers, colored plastic layers, or both, as further described below.

In another embodiment, the layers 42 and 46 can be colored paper and/or plastic layers, having different colors. The intervening layer 44 can be an adhesive layer designed to facilitate separation between layers 42 and 46 in the region of impact when a projectile penetrates the target label 30. The layer 44 can be any suitable adhesive, and can incorporate a release agent, such as a silicone release agent. The release agent can be used to control the adhesion between layers 42 and 46, and can facilitate localized separation between layers 42 and 46 when a projectile penetrates the target label 10. Suitable adhesives include without limitation solvent-based adhesives based on polyamide suspensions, polyacrylates, polyurethanes and the like, as well as extrudable polyolefin-based adhesives and ionomers having reactive functional groups.

In one embodiment, the layer 44 can incorporate a finely dispersed glitter. Glitter particles can be formed of aluminum, mica, malachite or the like, or can be formed of pigmented plastic flakes. The use of glitter particles provides a sparkling effect, thus enhancing the "starburst" or "halo" when a projectile penetrates the target 10.

The optional layer 48 of substrate 40 (shown above layer 42) can similarly be a layer of glitter, or an adhesive layer that contains glitter particles. The layer 48 can also be a layer of toner having a color different from the color of layer 42, or can be a layer of toner mixed with glitter. If the layer 48 is a toner layer, then the toner color will be the first (front-facing) color of the colored substrate 10. The layer 48 can also be combined with a release agent, such as a silicone release agent, that facilitates separation from the underlying colored layer 42 around the region of impact, when a projectile penetrates the target 10. When the layer 48 includes toner and/or glitter, the toner and/or glitter particles can scatter around the region surrounding the penetration by the projectile, simulating the visual appearance of gun powder.

The colored substrate 40 has a back surface 41 and a front surface 49, with the first color visible from the front surface 49. The laminate 30 may further include a transparent film 50 having a back surface 51 and a front surface 59. The back surface 51 of the transparent film 50 can be joined to the front surface 49 of the colored substrate 40 using an adhesive layer 53.

The transparent film 50 is suitably made of plastic, and can contain multiple layers, illustrated as layers 55 and 57. The plastic film layer(s) can be any transparent polymer material, including without limitation biaxially oriented polypropylene, linear low density polyethylene, ethylene vinyl acetate, polyethylene terephthalate, polybutylene terephthalate, polyamide, acrylic copolymers, and the like. The adhesive layer 53 can be selected from a wide variety of suitable adhesives, including without limitation solvent-based adhesives based on polyamide suspensions, polyacrylates, polyurethanes and the like, as well as extrudable polyolefin-based adhesives and ionomers having reactive functional groups. The adhesive layer 53 can optionally contain particles or flakes of glitter, as described above, provided that the concentration of glitter particles or flakes is not so high as to obscure the first color on the front surface 49 of colored substrate 40.

The target label 10 includes at least one release layer 60 overlaying the front surface 59 of transparent film 50. In the embodiment shown, a second release layer 62 separates the first release layer 60 from the toner layer 70, which defines an image of a target. The first release layer 60 facilitates separation from the transparent film 50 and can be formed of polytetrafluoroethylene, polyester, polyamide, polyacrylonitrile, or a silicone polymer. The second release layer 62 facilitates separation of the toner layer 70 and is suitably a silicone polymer or a release agent that includes a silicone polymer. The first release layer 60 can also be designed to facilitate release from both the transparent film 50 and the toner layer 70, by incorporating a release agent or agents (e.g. a silicone release agent) that is suitable for both purposes, in which case the second release layer 62 may not be needed.

In one embodiment, the release layers 60 and/or 62 may not be needed. The adhesion of toner layer 70 to transparent film 50 can be optimized to facilitate separation of the toner layer 70 using other techniques, including without limitation optimizing the surface tension of the front surface 59 of transparent film 50 by proper material selection, corona treatment to impart an electrostatic charge, and/or applying the toner using an aqueous carrier as described above. Regardless of the technique, the objective is to strike a suitable balance between adhesion and release that enables the toner layer 70 to remain intact until the target label 30 is struck by a firearm projectile, at which time the toner particles scatter outward from the region of impact.

The toner layer 70 defines the shape of a target. As shown in FIGS. 1 and 2, the toner layer 70 can have a first section 72 having a second color different from the first color, a second section 74 having a third color different from the first and second colors, and a third section 76 having a fourth color different from the first, second and third colors. The first and second sections 72 and 74 are separated by at least one gap 73. The second and third sections 74 and 76 are separated by at least one gap 75. The first color of the front surface 49 of colored substrate 40 can be viewed through the gaps 73 and 75. If the colored substrate 40 has multiple layers with different colors, then it is desirable for the first, second, third and fourth colors to be different from each other and from each of the multiple layers of the colored substrate 40.

The toner layer 70 can be applied as a single layer having multiple colors as shown. Alternatively, the toner layer 70 can include multiple layers of toner to create the desired target design. The toner layer 70 can be overlaid with one or more layers 80 and 82 of clear coating or varnish, shown only in FIG. 2. Clear coatings and varnishes are conventional. Any suitable clear coatings and varnishes can be used.

Figure 3:
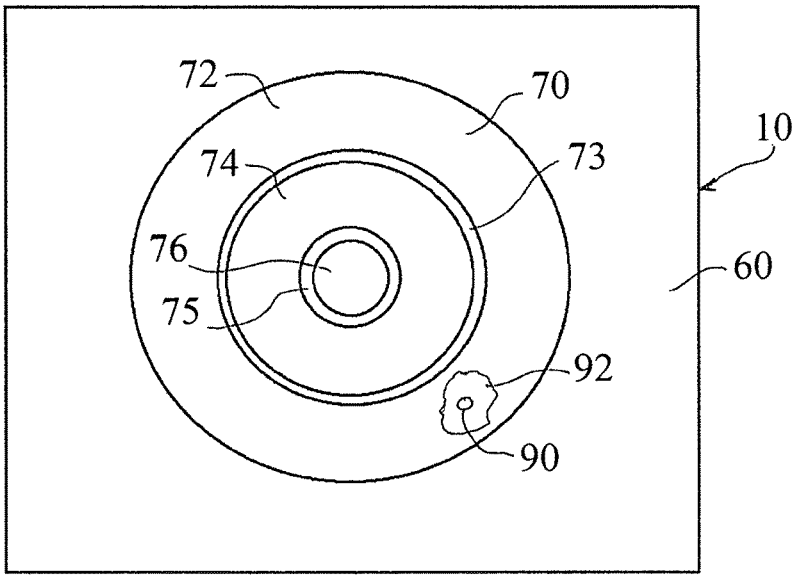
FIG. 3 illustrates one embodiment of the target label, after it has been penetrated by a projectile.

FIG. 3 illustrates a target label 10 after the target has been penetrated by a projectile, leaving a projectile opening 90. In this embodiment, the colored substrate 40 may have only one colored paper or plastic film layer 42. By operation of the release layer(s) 60 and 62 between the transparent film 50 and the toner layer 70, an area 92 of toner layer 70 is displaced which exceeds the diameter of the projectile opening 90. The contrasting first color of the front surface 49 of colored substrate 40 is exposed over the area 92, creating the visual impression of enhanced damage when the projectile hits the target label 70. The scattering of toner layer 70 over area 92 also contributes to a visual simulation of gun powder burns in the area 92.

Figure 4:
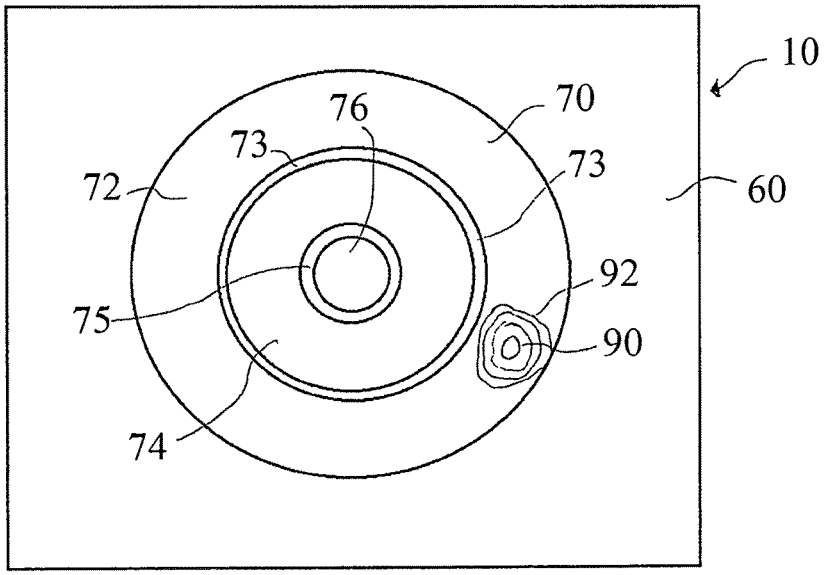
FIG. 4 illustrates another embodiment of the target label, after it has been penetrated by a projectile.

FIG. 4 illustrates a more complicated target label 10 after the target has been struck and penetrated by a projectile. In this embodiment, the colored substrate 40 may have multiple colored layers 42, 44, 46 and/or 48 as described above, with appropriate release agents existing in or between some of the layers, and/or with glitter particles or flakes present in one or more layers. In this embodiment, the area 92 has a multi-colored "starburst" or "halo" image. The precise image will, of course, vary depending on how many substrate layers are colored and/or contain glitter, the specific materials used for the colored layers, the specific colors, and the release properties between the colored layers. The layers can be specifically designed so that the toner layer 70 displaces over the entire area 90, and the underlying substrate layers of color and/or glitter displace over progressively smaller areas. This requires proper selection of layer thickness, layer materials, adhesive(s) and release properties between the layers.

Variations of the embodiments described above are also contemplated by the invention. In the simplest embodiment, the transparent film 50 can be eliminated and the toner layer 70 can be applied over the colored substrate 40, with appropriate release layer(s) or release agent(s) underlying the toner layer 70. In another embodiment, a release agent can be included within the toner layer 70, alleviating the need for the underlying release layer 62. The colored substrate 40, as described above, is suitably devoid of ink layers. As an alternative, one or more layers of the colored substrate 40 can be formed by applying an ink layer to an underlying paper or plastic film layer, and/or by including a release agent within the ink layer. Other variations are also possible.

The embodiments of the invention described herein are presently preferred. Various modifications and improvements can be made without departing from the spirit and scope of the invention. The scope of the invention is defined by the appended claims, and all changes that fall within the meaning and range of equivalents are intended to be embraced therein.

I claim:

1. A target label, comprising:

a colored substrate including a plurality of paper or plastic layers having different colors, the colored substrate having a front surface and a back surface, one of the layers defining the front surface and having a first color;

a transparent plastic film having a front surface and a back surface, the back surface of the transparent plastic film overlaying the front surface of the colored substrate;

a release layer overlaying the front surface of the transparent plastic film; and a toner layer defining an image of a target, overlaying the release layer, and having a second color different from the first color.

2. The target label of claim 1, wherein the paper or plastic layer having the first color is devoid of ink layers.

3. The target label of claim 1, wherein the colored substrate further comprises a toner layer having the first color and joined to the one of the layers defining the front surface.

4. The target label of claim 1, wherein the colored substrate comprises a plurality of paper layers having the different colors, one of the paper layers defining the front surface and having the first color.

5. The target label of claim 1, wherein the colored substrate comprises a plurality of plastic layers having the different colors, one of the plastic layers defining the front surface and having the first color.

6. The target label of claim 1, further comprising a release liner covering the back surface of the colored substrate and a releaseable adhesive joining the release liner to the back surface of the colored substrate.

7. The target label of claim 1, further comprising an adhesive layer joining the front surface of the colored substrate to the back surface of the transparent film.

8. The target label of claim 1, further comprising an adhesive layer joining at least two of the layers of the colored substrate.

9. The target label of claim 1, wherein the transparent plastic film comprises a plurality of film layers.

10. The target label of claim 1, wherein the release layer overlaying the front surface of the transparent plastic film comprises silicone.

11. The target label of claim 1, wherein the toner layer comprises a plurality of sections having different colors.

12. The target label of claim 11, wherein at least two of the sections are separated by gaps, visually exposing the front surface of the colored substrate.

13. The target label of claim 1, further comprising a clear coating layer overlaying the toner layer.

14. A target label, comprising:

a colored substrate including paper and plastic layers having different colors, the colored substrate having a front surface and a back surface, one of the paper or plastic layers defining the front surface and having a first color;

a transparent plastic film having a front surface and a back surface, the back surface of the transparent plastic film overlaying the front surface of the colored substrate;

a release layer overlaying the front surface of the transparent plastic film; and a toner layer defining an image of a target, overlaying the release layer, and having a second color different from the first color.

15. The target label of claim 14, wherein the one of the paper or plastic layer having the first color is devoid of ink layers.

16. The target label of claim 14, wherein the colored substrate further comprises a toner layer having the first color and joined to the one of the layers defining the front surface.

17. The target label of claim 14, further comprising a release liner covering the back surface of the colored substrate and a releasable adhesive joining the release liner to the back surface of the colored substrate.

18. The target label of claim 14, wherein the toner layer comprises a plurality of sections having different colors, wherein at least two of the sections are separated by gaps, visually exposing the front surface of the colored substrate.

19. The target label of claim 14, further comprising a clear coating layer overlaying the toner layer.

20. A target label, comprising:

a colored substrate including at least one paper or plastic layer and having a first color, the colored substrate having a front surface and a back surface;

a transparent plastic film having a front surface and a back surface, the back surface of the transparent plastic film overlaying the front surface of the colored substrate;

an adhesive layer joining the front surface of the colored substrate to the back surface of the transparent film;

glitter particles dispersed in the adhesive layer;

a release layer overlaying the front surface of the transparent plastic film; and a toner layer defining an image of a target, overlaying the release layer, and having a second color different from the first color.

21. The target label of claim 20, wherein the one of the paper or plastic layer having the first color is devoid of ink layers.

22. The target label of claim 20, wherein the colored substrate further comprises a toner layer having the first color and joined to the one of the layers defining the front surface.

23. The target label of claim 20, further comprising a release liner covering the back surface of the colored substrate and a releasable adhesive joining the release liner to the back surface of the colored substrate.

24. A target label, comprising:

a colored substrate including at least two paper or plastic layers and having a first color, the colored substrate having a front surface and a back surface;

an adhesive layer joining at least two of the layers of the colored substrate;

glitter particles dispersed in the in the adhesive layer;

a transparent plastic film having a front surface and a back surface, the back surface of the transparent plastic film overlaying the front surface of the colored substrate;

a release layer overlaying the front surface of the transparent plastic film; and a toner layer defining an image of a target, overlaying the release layer, and having a second color different from the first color.

25. A target label, comprising:

a colored substrate including at least one paper or plastic layer and having a first color, the colored substrate having a front surface and a back surface;

an adhesive layer adjacent to at least one of the paper or plastic layers of the colored substrate;

glitter particles dispersed in the adjacent layer;

a toner layer defining an image of a target, overlaying the front surface of the colored substrate and having a second color different from the first color; and a release agent in or adjacent to the toner layer;

wherein the toner layer includes first and second sections and at least one gap between the first and second sections, the first section having a second color, the second section having a third color, the first, second and third colors being different from each other.

26. The target label of claim 25, further comprising a transparent plastic film having a front surface and a back surface, the back surface of the transparent plastic film overlaying the front surface of the colored substrate.

27. The target label of claim 25, wherein the colored substrate comprises multiple layers, one of the layers having the first color, the remaining layers having colors that are different from each other and from the first, second and third colors.

28. The target label of claim 25, wherein the toner layer further comprises a third section and at least one gap between the second and third sections, the third section having a fourth color different from the first, second and third colors.

* * * * *